United States Patent [19]

Baranow

[11] 4,156,053

[45] May 22, 1979

[54] METHOD OF MAKING OXIDE DISPERSION STRENGTHENED POWDER

[75] Inventor: Sanford Baranow, Sauquoit, N.Y.

[73] Assignee: Special Metals Corporation, New Hartford, N.Y.

[21] Appl. No.: 893,217

[22] Filed: Apr. 4, 1978

Related U.S. Application Data

[63] Continuation-in-part of Ser. No. 721,004, Sep. 7, 1976, abandoned.

[51] Int. Cl.[2] ..... B22F 1/00

[52] U.S. Cl. ..... 428/570; 75/0.5 BC; 75/206; 75/211; 75/251

[58] Field of Search ..... 75/0.5 BC, 211, 206, 75/251, 252, 228; 428/570

[56] References Cited

U.S. PATENT DOCUMENTS

| | | | |
|---|---|---|---|
| 3,716,357 | 2/1973 | Evans et al. | 75/0.5 BC |
| 3,765,867 | 10/1973 | Evans et al. | 75/0.5 BC |
| 3,778,249 | 12/1973 | Benjamin | 75/0.5 BC |

FOREIGN PATENT DOCUMENTS

| | | | |
|---|---|---|---|
| 684359 | 4/1964 | Canada | 75/0.5 BC |
| 869929 | 5/1971 | Canada | 75/0.5 BC |
| 2102538 | 5/1971 | Fed. Rep. of Germany | 75/0.5 BC |
| 821336 | 8/1956 | United Kingdom | 75/0.5 BC |

*Primary Examiner*—Brooks H. Hunt

*Attorney, Agent, or Firm*—Vincent G. Gioia; Robert F. Dropkin

[57] ABSTRACT

A process for preparing metal having a substantially uniform dispersion of hard filler particles. The process includes the steps of: admixing particles of a first metallic component with oxide particles having a negative free energy of formation at 1000° C. of at least as great as that of aluminum oxide, and with a dissimilar second metallic component; and of milling for a period of time sufficient to produce powder characterized by a substantially uniform dispersion of hard filler particles and heterogeneous agglomerations of at least two metallic components. The first metallic component is from the group consisting of nickel, cobalt, iron and alloys thereof. Both the first and the second metallic component have an average particle size of less than 10 microns.

11 Claims, No Drawings

METHOD OF MAKING OXIDE DISPERSION STRENGTHENED POWDER

This application is a continuation-in-part of copending application Ser. No. 721,004 filed Sept. 7, 1976 now abandoned.

The present invention relates to a process for preparing metal having a substantially uniform dispersion of hard filler particles.

U.S. Pat. No. 3,591,362 discloses a process for preparing dispersion strengthened metallic powder; and in a particular instance, oxide strengthened metallic powder prepared by a process known as mechanical alloying. Involved therein are lengthy milling periods; e.g. 24 hours, and a type of milling described therein as "high energy" or "agitation milling".

Through the present invention, a shortened process for preparing oxide strengthened metallic powder is provided. No longer is it necessary to mill powder for the lengthy period disclosed in U.S. Pat. No. 3,591,362. In accordance with the principles set for hereinbelow, the present invention discloses a process which often requires less than 2 hours for milling.

In addition to the obvious benefit of increased efficiency of production, shortened milling periods are additionally accompanied by other benefits which include less oxygen in the final product, a higher yield and easier cleanup of the milling media. Moreover, long milling times disadvantageously lead to welding between the powder and the milling media, and to the production of highly cold-worked particles which cannot be cold consolidated.

The benefits of the subject invention are accomplished by blending metal and oxide particles with dissimilar metallic additions of a very small size; e.g. 4 microns. It has been found that certain metals act as a deterent to the rapid comminution of metallic additions. For example, a cushioning effect is attributable to nickel which is initially relatively soft; and said cushioning effect leads to an extended milling cycle. Said deterrent is removed with the use of additions of a very small size. By comparison, the additions of U.S. Pat. No. 3,591,362 are relatively coarse.

It is accordingly an object of the present invention to provide a more efficient process for preparing oxide strengthened metallic powder.

In accordance with the present invention: particles of a first metallic component are admixed with oxide particles having a negative free energy of formation at 1000° C. of at least as great as that of aluminum oxide, and with a dissimilar second metallic component; and milled for a period of time sufficient to produce powder characterized by a substantially uniform dispersion of hard filler particles and heterogeneous agglomerations of at least two metallic components. The heterogeneous agglomerations of the metallic components are distinguishable through election microscopy. Milling can be initiated with two of the three referred to powders or with all three admixed. It is preferably, but not necessarily, performed in an inert atmosphere. Time of milling is generally less than 4 hours, and usually less than 2 hours. Milling is accomplished in a high energy mill. Although attritors are preferred, it is within the scope of the invention to use other high energy mills which include vibratory mills and jet mills (also known as fluid energy mills).

The first metallic component is from the group consisting of nickel, cobalt, iron and alloys thereof. Most often it is from the group consisting of nickel, cobalt and alloys thereof. The average particle size of said component is less than 10 microns. Average particle sizes would generally speaking not be less than one micron.

The oxide particles must have a negative free energy of formation at 1000° C. of at least as great as that of aluminum oxide. Oxides of yttrium and thorium are particularly suitable for use with nickel, cobalt and alloys thereof. The average particle size of the oxide particles is generally less than 0.01 micron.

The second metallic component can be comprised of any of those elements found in high temperature alloys. It is often an alloy of chromium; but can be an alloy of chromium and aluminum or an alloy of aluminum and/or titanium or one of many others known to those skilled in the art. In any event, the component must have an average particle size of less than 10 microns. Particle sizes of less than 5 microns are, however, preferred. As with the first metallic component particle sizes would generally speaking, not be less than one micron.

The dispersion strengthened metal powder produced in accordance with the subject invention is suitable for consolidation by any number of methods. Exemplary methods include extrusion, rolling, swaging and forging.

The following example is illustrative of several aspects of the invention.

Two hundred and sixty grams of an 80 Cr-20 Al alloy were crushed to an average particle size of 4 microns and subsequently mixed with 1024 grams of carbonyl nickel and 16 grams of $Y_2O_3$. The carbonyl nickel had an average particle size of less than 10 microns, and that for the $Y_2O_3$ was 150 angstroms. The proportions of the components were chosen to produce a batch of powder consisting essentially of 16 Cr, 4 Al, 1.2 $Y_2O_3$ balance Ni. The admixed powder was milled in an attritor, under argon, for one-half hour and subsequently discharged. The powder was then packed into a mild steel container of $2\frac{5}{8}$ inches O.D.; which was evacuated, sealed and extruded through a $0.4 \times 1.2$ inch die at 2050° F. A specimen was then recrystallized at 2450° F. and tested. It was found to have a cube-on-edge texture and a 2000° F. life of 13 hours at a stress level of 9 ksi. In addition, at failure its elongation was 18.4% and its reduction in area was 21.0%. Material such as this is of sufficient strength, ductility, and inherent corrosion resistance to be utilized as an uncoated turbine vane in most jet engine applications.

It will be apparent to those skilled in the art that the novel principles of the invention disclosed herein in connection with specific examples thereof will suggest various other modifications and applications of the same. It is accordingly desired that in construing the breadth of the appended claims that they shall not be limited to the specific examples of the invention described herein.

I claim:

1. A process for preparing metal having a substantially uniform dispersion of hard filler particles, which comprises the steps of: admixing particles of a first metallic component with oxide particles having a negative free energy of formation at 1000° C. of at least as great as that of aluminum oxide, and with a dissimilar second metallic component, said first metallic component being from the group consisting of nickel, cobalt, iron and alloys thereof, said first metallic component having an average particle size of less than 10 microns, said oxide particles having an average particle size of less than 0.1 micron; said second metallic component having an average particle size of less than 10 microns; and milling said powders in a high energy mill for a period of time sufficient to produce powder characterized by a substantially uniform dispersion of hard filler particles, said milled powder being additionally characterized by heterogeneous agglomerations of at least two metallic components, said metallic components being distinguishable through electron microscopy, said milling being accomplished in a period of less than 4 hours.

2. A process according to claim 1, wherein said second metallic component has an average particle size of less than 5 microns.

3. A process according to claim 1, wherein said second metallic component is an alloy containing chromium.

4. A process according to claim 3, wherein said second metallic component is an alloy containing chromium and aluminum.

5. A process according to claim 4, wherein said first metallic component is from the group consisting of nickel, cobalt and alloys thereof.

6. A process according to claim 5, wherein said second metallic component has an average particle size of less than 5 microns.

7. A process according to claim 1, including the step of crushing said second metallic component to said average particle size of less than 10 microns.

8. A process according to claim 1, wherein said first metallic component is from the group consisting of nickel, cobalt and alloys thereof.

9. A process according to claim 1, wherein said milling is accomplished in a period of less than 2 hours.

10. A process according to claim 9, wherein said second metallic component has an average particle size of less than 5 microns.

11. Dispersion strengthened metallic powder characterized by a substantially uniform dispersion of hard filler particles and heterogeneous agglomerations of a least two metallic components, said metallic components being distinguishable through electron microscopy; said dispersion strengthened metallic powder being made in accordance with the process of claim 1.

* * * * *